US006378141B1

(12) United States Patent
Lew

(10) Patent No.: US 6,378,141 B1
(45) Date of Patent: Apr. 30, 2002

(54) TOILET BOWL STABILIZER

(75) Inventor: Wing G. Lew, Los Angeles, CA (US)

(73) Assignee: Sachwin Products, Inc., Torrance, CA (US)

( * ) Notice: Subject to any disclaimer, the term of this patent is extended or adjusted under 35 U.S.C. 154(b) by 0 days.

(21) Appl. No.: 09/619,850

(22) Filed: Jul. 20, 2000

(51) Int. Cl.[7] ..... E03D 11/00
(52) U.S. Cl. ..... 4/252.1
(58) Field of Search ..... 4/252.1, 252.4, 4/252.5, 252.6, 254; 285/56–60

(56) References Cited

U.S. PATENT DOCUMENTS 2,152,719 A * 4/1939 Williams ..... 4/252.6
4,515,398 A * 5/1985 Machon, Sr. ..... 4/252.5
5,303,430 A * 4/1994 Fernie et al. ..... 4/254
5,309,579 A * 5/1994 Nelson ..... 4/252.1
5,608,972 A * 3/1997 Lewis ..... 4/252.51

* cited by examiner

*Primary Examiner*—Charles E. Phillips
(74) *Attorney, Agent, or Firm*—Frederick Gotha

(57) ABSTRACT

A toilet bowl stabilizer base of a plurality of interlocking plates nest together for compression between the bottom of the new toilet bowl and the supporting floor. The plates are congruent and of the same dimensions and have opposing planar surfaces with a circular opening for receipt of the mounting flange and passage of waste. Each base plate has a pair of alignment pegs and cooperating recesses on the opposing side of the plate to interlock the plates together.

4 Claims, 3 Drawing Sheets

TOILET BOWL STABILIZER

FIELD OF THE INVENTION

The present invention relates to plumbing in general, and in particular, to a toilet bowl stabilizer that minimizes any instability that would otherwise occur when the mounting flange of the waste line drainage line is too high for the support surface of the toilet bowl.

BACKGROUND OF THE INVENTION

Toilet bowls couple to sewage waste line with a mounting flange of a mounting hub through stud and nut connections. A wax ring of the hub provides a gasket.

Replacement of a toilet bowl requires removal of the old toilet bowl from a mounting flange on the waste line. The mounting flange is usually a standard distance above a toilet bowl-supporting surface (floor) for the bowl. Sometimes the replacement toilet bowl is not within the tolerance limits of the standard height of the mounting flange above the floor. If so, the replacement toilet bowl maybe too high above the supporting floor, and not seat properly on the flange. The consequence of this is that the new bowl is unstable and can wobble or rock. Further if the base ring around the base of the old toilet bowl is larger than the base of the new toilet bowl there is a good chance of an unsightly ring around the base of the new toilet left over from the old installation.

SUMMARY OF THE INVENTION

The present invention provides an easy to use toilet bowl stabilizer base plate that stabilizes a replacement toilet bowl simply and effectively so that it does not rock. In addition it avoids an unsightly ring even when the new toilet bowl mounting flange is located outside the tolerance and too high above the toilet bowl support floor. A single stabilizer base plate or a plurality of plates of the invention between the floor support surface and the bottom of the replacement toilet bowl stabilizes the new toilet bowl.

In greater detail, the present invention provides a toilet bowl stabilizer base of a plurality of interlocking plates that nest together for compression between the bottom of the new toilet bowl and the supporting floor. The plates are congruent and of the same dimensions and have opposing planar surfaces with a circular opening for receipt of the mounting flange and passage of waste. Preferably each base plate has a pair of alignment pegs and cooperating recesses on the opposing side of the plate to interlock them.

The toilet bowl stabilizer of this invention is easy to install and avoids toilet bowl rocking and avoids unsightly old floor pattern mark from the old toilet bowl.

BRIEF DESCRIPTION OF THE INVENTION

DESCRIPTION OF THE PRESENTLY PREFERRED EMBODIMENT

Figure 1:
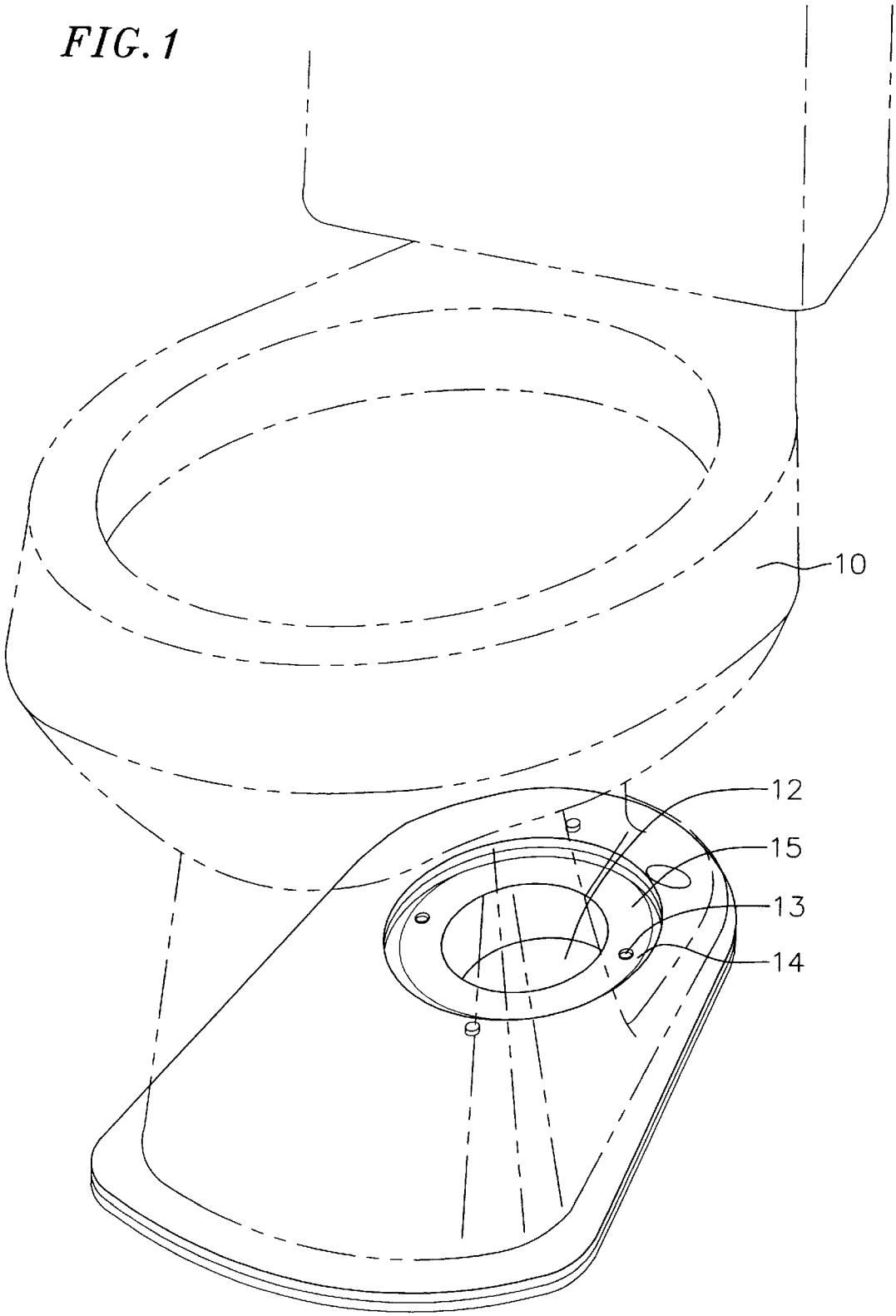
FIG. 1 is a perspective view of a standard toilet fixture (shown in phantom) with the toilet bowl stabilizer plates of the present invention.
Figure 2:
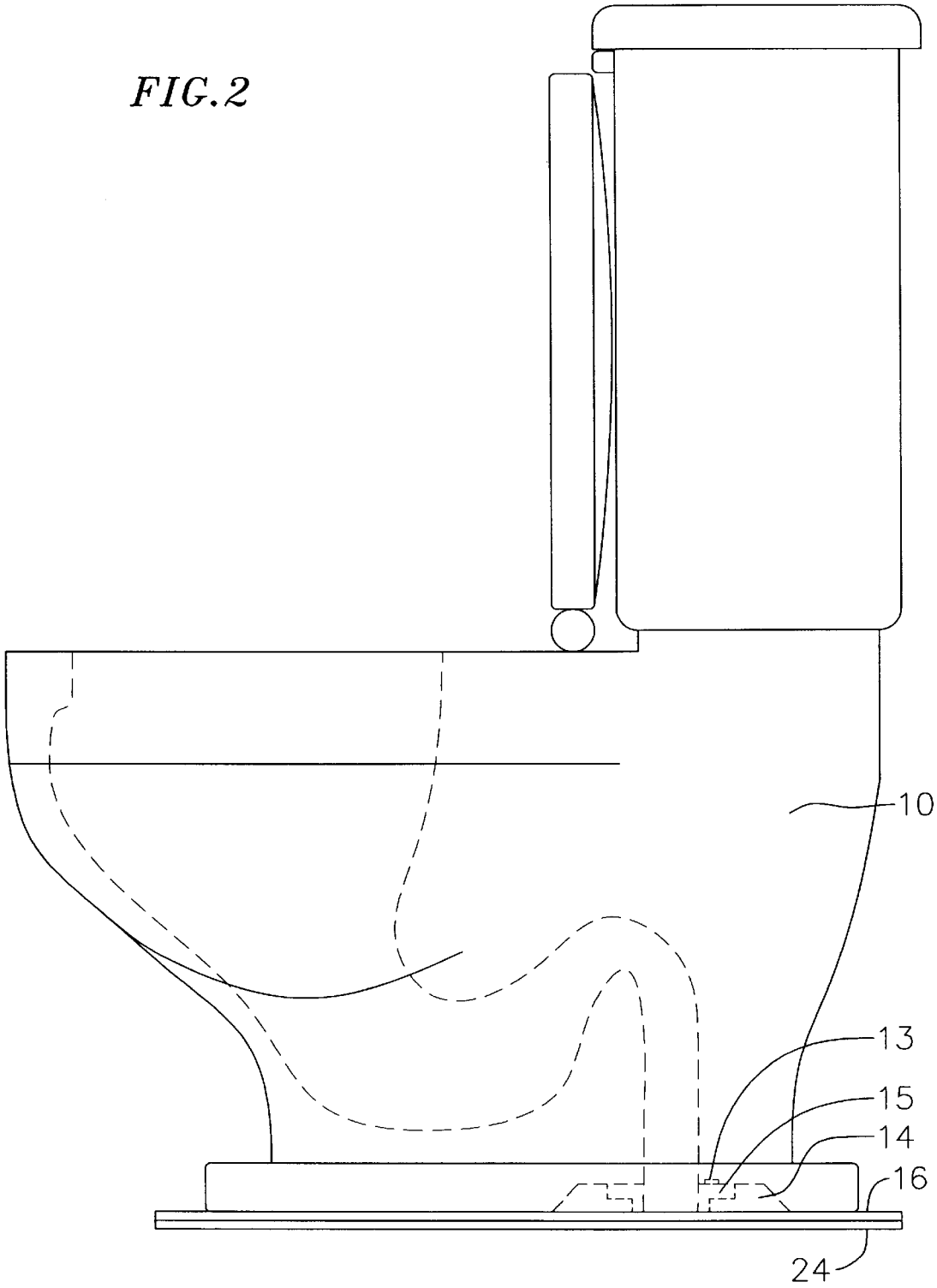
FIG. 2 is side elevational view of the toilet bowl and stabilizer of FIG. 1.

With reference to the FIGS. 1 and 2 a standard toilet bowl 10 mounts over a waste line opening 12. A wax ring and drainage hub 14 form the entrance to the waste line. The drainage hub has a toilet bowl mounting flange 15, which has either female threads 13 for mounting bolts or alternatively mounting studs for mounting nuts.

Figure 3:
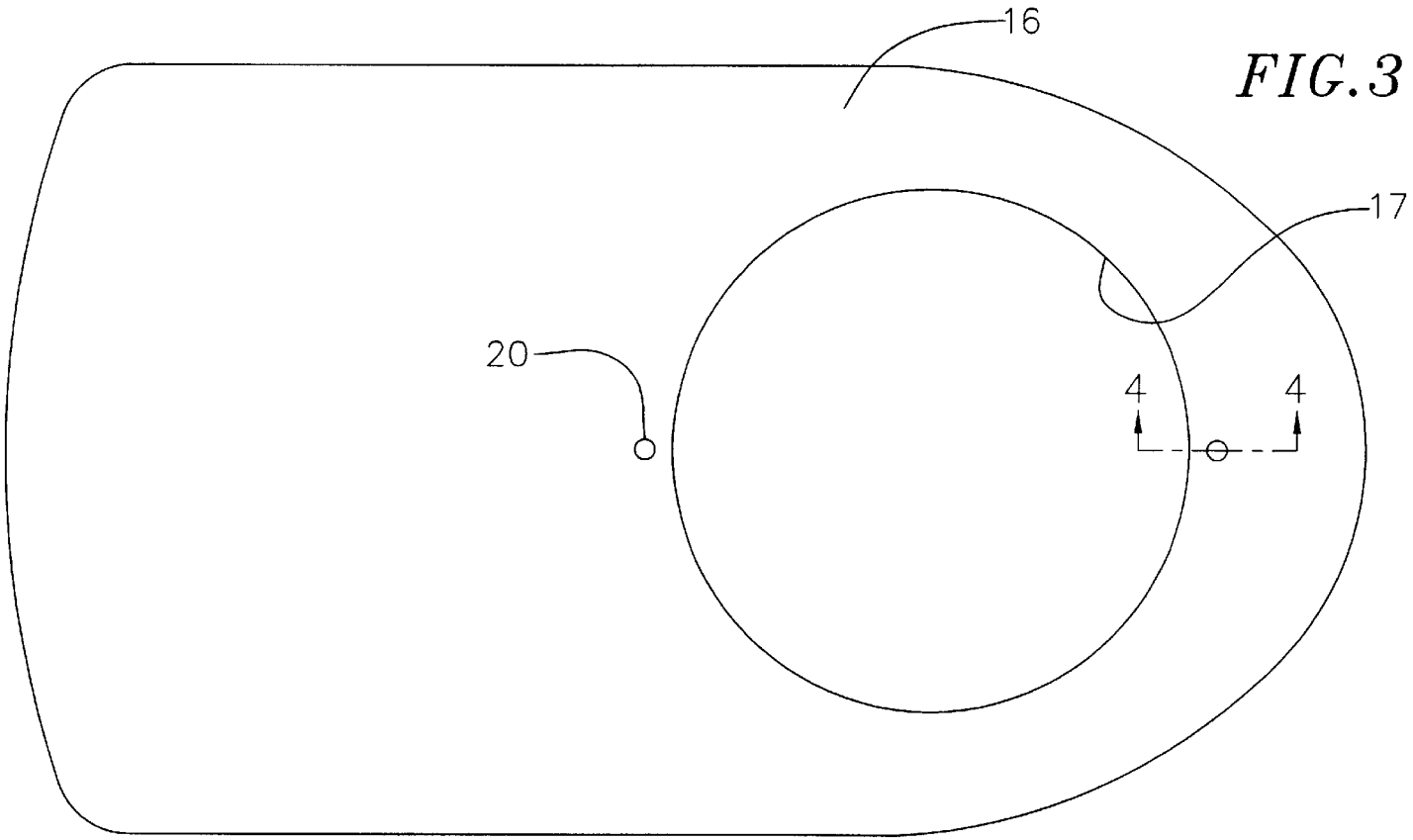
FIG. 3 is a top plan view of a stabilizer plate.
Figure 4:
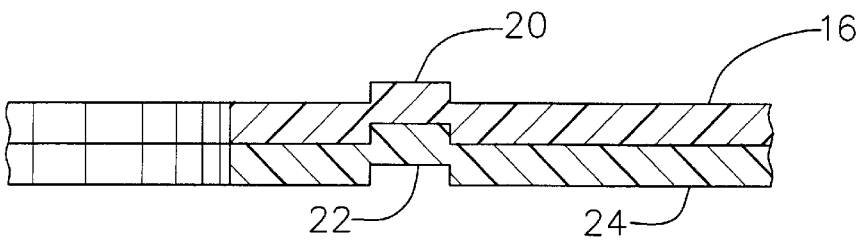
FIG. 4 is a view taken in the plane of 4—4 of FIG. 3 showing the interlock of pegs and complementary recess of the stabilizer plates of this invention.

A toilet bowl stabilizer base 16, seen best in FIGS. 3 and 4 stabilizes the toilet bowl. The base has an opening 17 that receives the wax ring and drainage hub 14. An upper surface 16 of the stabilizer base plate has a peg 20 that is received in a complementary recess 22 of a second stabilizing plate 24 when more than one plate is necessary to properly align and true the toilet bowl. The plates are made from compressible elastomeric material. This assures good seating on the toilet bowl supporting floor.

The toilet base is very easy to install. The installer turns off the water supply to the old toilet bowl. The water supply line to the old toilet bowl is removed. The old toilet bowl is then removed by unscrewing the mounting nuts (not shown) from cooperating studs (not shown) in the drainage hub flange.

I have described the preferred embodiment of present invention The spirit and scope of the appended claims should not however, necessarily be limited to this description.

I claim:

1. A stabilizing device for stabilizing a toilet bowl mounted on a mounting flange of a drainage hub extending above a floor surface comprising, (a) a plurality of stabilizing plates each said stabilizing plate having an upper surface, a lower surface and an opening therein to receive said mounting flange, and (b) an alignment peg protruding upward from each said upper surface of each said stabilizing plate and a recess in said lower surface of each said stabilizing plate for receiving said alignment peg to permit the nesting of said stabilizer plates between said floor surface and said toilet bowl thereby stabilizing said toilet bowl against said floor surface said plates being of such a size so as to receive a base of a toilet bowl thereon,for support of said toilet bowl and being of such a thickness wherein at least two of said stabilizing plates superimposed and applied around said mounting flange in use do not elevate the height of an upper surface of a toilet bowl mounted thereon with respect to said flange.

2. The stabilizing device recited in claim 1 wherein each said stabilizer plate is congruent.

3. In combination:

(a) A toilet bowl for mounting on a mounting flange of a drainage hub extending above a floor surface; and (b) A plurality of stabilizing plates each said stabilizing plate having an upper surface, a lower surface and an opening therein to receive said mounting flange, and an alignment peg protruding upward from each said upper surface of each said stabilizing plate and a recess in said lower surface of each said stabilizing plate for receiving said alignment peg to permit the nesting of said stabilizer plates between said floor surface and said toilet bowl thereby stabilizing said toilet bowl against said floor surface said plates being of such a size so as to receive a base of a toilet bowl thereon,for support of said toilet bowl and being of such a thickness wherein at least two of said stabilizing plates superimposed and applied around said mounting flange in use do not elevate the height of an upper surface of a toilet bowl mounted thereon with respect to said flange.

4. The combination recited in claim 3 wherein each said stabilizer plate is congruent.

* * * * *